US010626550B2

(12) United States Patent
Prevoir et al.

(10) Patent No.: US 10,626,550 B2
(45) Date of Patent: Apr. 21, 2020

(54) WATER-RESISTANT COMPOSITION

(71) Applicant: Bose Corporation, Framingham, MA (US)

(72) Inventors: Shawn J. Prevoir, Northborough, MA (US); Philip Lawrence Smith, Auburn, MA (US)

(73) Assignee: Bose Corporation, Framingham, MA (US)

( * ) Notice: Subject to any disclaimer, the term of this patent is extended or adjusted under 35 U.S.C. 154(b) by 565 days.

(21) Appl. No.: 14/950,648

(22) Filed: Nov. 24, 2015

(65) Prior Publication Data

US 2017/0145629 A1 May 25, 2017

(51) Int. Cl.
*H04R 7/00* (2006.01)
*D06N 3/18* (2006.01)
(Continued)

(52) U.S. Cl.
CPC ..... *D06N 3/183* (2013.01); *D06M 15/37* (2013.01); *D06N 3/0006* (2013.01); *D06N 3/0036* (2013.01); *D06N 3/0059* (2013.01); *D06N 3/0088* (2013.01); *D06N 3/042* (2013.01); *D06N 3/047* (2013.01); *D06N 3/10* (2013.01); *D06N 3/103* (2013.01); *D06N 3/106* (2013.01); *H04R 5/02* (2013.01); *H04R 7/02* (2013.01); *H04R 7/18* (2013.01); *H04R 31/003* (2013.01); *D06M 2101/06* (2013.01); *D06M 2101/32* (2013.01); *D06M 2200/12* (2013.01); *D06N 2209/02* (2013.01); *D06N 2209/128* (2013.01); *D10B 2201/02* (2013.01); *D10B 2331/04* (2013.01);
(Continued)

(58) Field of Classification Search
CPC . D04N 3/183; H04R 7/00; H04R 7/02; H04R 7/04
USPC ..... 181/148, 149, 157, 167, 169, 170; 442/64, 66, 71, 79, 82, 85, 86, 88
See application file for complete search history.

(56) References Cited

U.S. PATENT DOCUMENTS 3,165,587 A * 1/1965 Alderson ..... H04R 1/2819 181/145
3,328,537 A * 6/1967 Hecht ..... H04R 7/12 181/169
(Continued)

FOREIGN PATENT DOCUMENTS

JP H06 153292 5/1994
JP 2001 197590 7/2001
JP 2001197590 A * 7/2001

OTHER PUBLICATIONS

International Search Report and Written Opinion; PCT/US2016/062013; dated Feb. 22, 2017.
(Continued)

*Primary Examiner* — Matthew D Matzek
(74) *Attorney, Agent, or Firm* — Fish & Richardson P.C.

(57) ABSTRACT

An example composition includes a cloth, which has on each side thereof, a first waterproofing agent, a barrier which inhibits or prevents environmental degradation, and an elastomeric barrier including a second waterproofing agent. Another example composition includes a cloth with a phenolic resin coating having, on each side thereof, a first waterproofing agent, a barrier which inhibits or prevents environmental degradation, and an elastomeric barrier including a second waterproofing agent.

20 Claims, 6 Drawing Sheets

(51) Int. Cl.

| | |
|---|---|
| ***D06N 3/10*** | (2006.01) |
| ***D06N 3/00*** | (2006.01) |
| ***H04R 7/18*** | (2006.01) |
| ***H04R 31/00*** | (2006.01) |
| ***D06M 15/37*** | (2006.01) |
| ***D06N 3/04*** | (2006.01) |
| ***H04R 5/02*** | (2006.01) |
| ***H04R 7/02*** | (2006.01) |
| *D06M 101/06* | (2006.01) |
| *D06M 101/32* | (2006.01) |

(52) U.S. Cl.
CPC .... *D10B 2401/021* (2013.01); *D10B 2505/00* (2013.01); *H04R 2231/003* (2013.01); *H04R 2307/023* (2013.01); *H04R 2307/025* (2013.01); *H04R 2307/029* (2013.01); *H04R 2307/204* (2013.01)

(56) References Cited

U.S. PATENT DOCUMENTS

| | | | | |
|---|---|---|---|---|
| 7,913,808 | B2 | 3/2011 | Fehervari et al. | |
| 8,315,420 | B2 | 11/2012 | Schneider et al. | |
| 2004/0026164 | A1 | 2/2004 | Takahashi et al. | |
| 2005/0112969 | A1* | 5/2005 | Snowden | D06M 11/13 442/93 |
| 2006/0199917 | A1* | 9/2006 | Chino | C08F 8/30 525/374 |
| 2010/0159223 | A1* | 6/2010 | Keese | C09D 127/18 428/219 |

OTHER PUBLICATIONS

International Preliminary Report on Patentability and Written Opinion; PCT/US2016/062013; dated Jun. 7, 2018; 10 pages.

* cited by examiner

FT-IR

DSC

DSC

WATER-RESISTANT COMPOSITION

TECHNICAL FIELD

This disclosure relates to water-resistant compositions that may be used, e.g., as components speakers or other appropriate devices.

BACKGROUND

A speaker, such as a loudspeaker, includes an electroacoustic transducer having a diaphragm and a linear motor. When driven by an electrical signal, the linear motor moves the diaphragm and causes airborne vibrations. The diaphragm in general includes a cone and dust cap, both of which can be made of paper. The diaphragm includes suspension elements such as surrounds and spiders to achieve pistonic motion.

SUMMARY

Described herein are examples of compositions that include a cloth which has, on each side thereof, a first waterproofing agent, a barrier which inhibits or prevents environmental degradation, and an elastomeric barrier including a second waterproofing agent.

In some implementations, the cloth is about 10-90 wt % of the composition. In some implementations, the cloth is cotton, polyester, or a mixture thereof. In some implementations, the cloth has greater than about 35 and less than about 55 warp threads per inch, and greater than about 35 and less than about 55 weft threads per inch. For example, the cloth has about 46 warp threads per inch and 46 weft threads per inch.

In some implementations, the compositions include a stiffening agent; and the stiffening agent is applied to the cloth prior to treatment with the first waterproofing agent, the barrier which inhibits or prevents environmental degradation, and the elastomeric barrier. In some implementations, the stiffening agent is phenolic resin, an epoxy, urethane, an amino resin, or a polyester. For example, stiffening agent is about 0.1-3 wt % of the composition.

In some implementations, the first waterproofing agent is a fluoropolymer, a silicone, or a hydrocarbon-based material. For example, the fluoropolymer includes about 20-30 wt % of fluoroalkyl acrylate copolymer and about 1-10 wt % tripropylene glycol.

In some implementations, the barrier which inhibits or prevents environmental degradation is about 10-90 wt % of the composition. In some implementations, the barrier which inhibits or prevents environmental degradation is an acrylic rubber. For example, the acrylic rubber includes greater than about 50 wt % of acrylic polymer.

In some implementations, the elastomeric barrier is about 10-90 wt % of the composition. In some implementations, the elastomeric barrier includes a thermoset rubber or a thermoplastic elastomer. For example, the thermoset rubber includes styrene butadiene rubber (SBR), acrylonitrile butadiene rubber (NBR), fluorinated rubber, polyurethane, silicone, and a mixture thereof. In some implementations, the thermoset rubber is a mixture including SBR and NBR. For example, the mixture includes about 15-20 wt % SBR and about 25-30 wt % NBR. In some implementations, the thermoplastic elastomer includes styrenic block copolymers, thermoplastic vulcanizates, thermoplastic polyurethane, thermoplastic silicone vulcanizate (TPSiV), and a mixture thereof.

In some implementations, the elastomeric barrier includes about 0.1-5 wt % of the second waterproofing agent. For example, the second waterproofing agent includes a fluoropolymer, a silicone, or a hydrocarbon-based material. In some implementations, the fluoropolymer includes about 20-30 wt % of fluoroalkyl acrylate copolymer and about 1-10 wt % tripropylene glycol.

Described herein are also example compositions that include a cloth with stiffening agent which has, on each side thereof, a first waterproofing agent, a barrier which inhibits or prevents environmental degradation, and an elastomeric barrier including a second waterproofing agent, where the cloth is about 10-90 wt % of the composition.

In some implementations, the compositions provided herein include a cloth with a phenolic resin coating having, on each side thereof, a first fluoropolymer, acrylic rubber, and a mixture including SBR, NBR, and a second fluoropolymer.

Described herein are also methods of producing an example composition that includes a cloth which has, on each side thereof, a first waterproofing agent, a barrier which inhibits or prevents environmental degradation, and an elastomeric barrier including a second waterproofing agent, and the method includes treating the cloth with the first waterproofing agent to produce a treated cloth; coating both sides of the treated cloth with the barrier to produce a coated cloth; and coating both sides of the coated cloth with the elastomeric barrier including the second waterproofing agent.

In some implementations, the methods provided herein further include treating the cloth with a stiffening agent prior to treating the cloth with the first waterproofing agent.

In general, in one aspect, the present disclosure relates to an apparatus including a component made from a composition described herein. In another aspect, the apparatus is an acoustic device such as a speaker. In some implementations, the acoustic device includes a suspension element made from a composition described herein. For example, the component is speaker component such as a surround.

Any two or more of the features described in this specification, including in this summary section, can be combined to form implementations not specifically described herein.

The details of one or more implementations are set forth in the accompanying drawings and the description below. Other features and advantages will be apparent from the description and drawings, and from the claims.

DETAILED DESCRIPTION

This disclosure relates to example compositions that include a cloth which has, on each side thereof, a first waterproofing agent, a barrier which inhibits or prevents environmental degradation, and an elastomeric barrier that includes a second waterproofing agent. The compositions described herein may be useful as speaker components such as a suspension element in an acoustic device. In some implementations, the compositions may serve as an acoustic seal and as a barrier to water or soapy water. In some implementations, the compositions described herein include a cloth having a stiffening agent and, on each side of the cloth, a first waterproofing agent and one or more layers of elastomeric materials that include a second waterproofing agent.

The example compositions described herein may be used as loudspeaker components, such as surrounds, and may have advantages. For example, the compositions may be water-resistant or waterproof Example methods used to assess the level of water-resistance in a composition include, but are not limited to the following. Compositions coated with rubber or plastics that satisfy the minimum requirements for hydrostatic resistance under ASTM D3393-91 are considered waterproof A Mullens tester can be used to test the composition, in which a sample is flexed five times within one minute by applying and releasing a pressure of 30 psi an after the fifth flex, the pressure of 30 psi is maintained for 60 seconds. The surface of the composition is visually inspected for water. A high flow water test can be employed to evaluate speaker or speaker components made from example compositions provided herein. The high flow water test includes continuously spraying a speaker or a component thereof with 3.1 liter of water per minute for 24 hours as the speaker or component is flexed for one hour, followed by one hour off increments. The high flow water test can include testing the speaker or speaker components at 80% of their resonance frequency at half the maximum power. The surface of the speaker or component is visually inspected for water.

In some implementations, a composition is considered "waterproof" when that composition satisfies the minimum requirements under ASTM D3393-91 and/or the high flow water test. However, other definitions of "waterproof" may be used.

Figure 5:
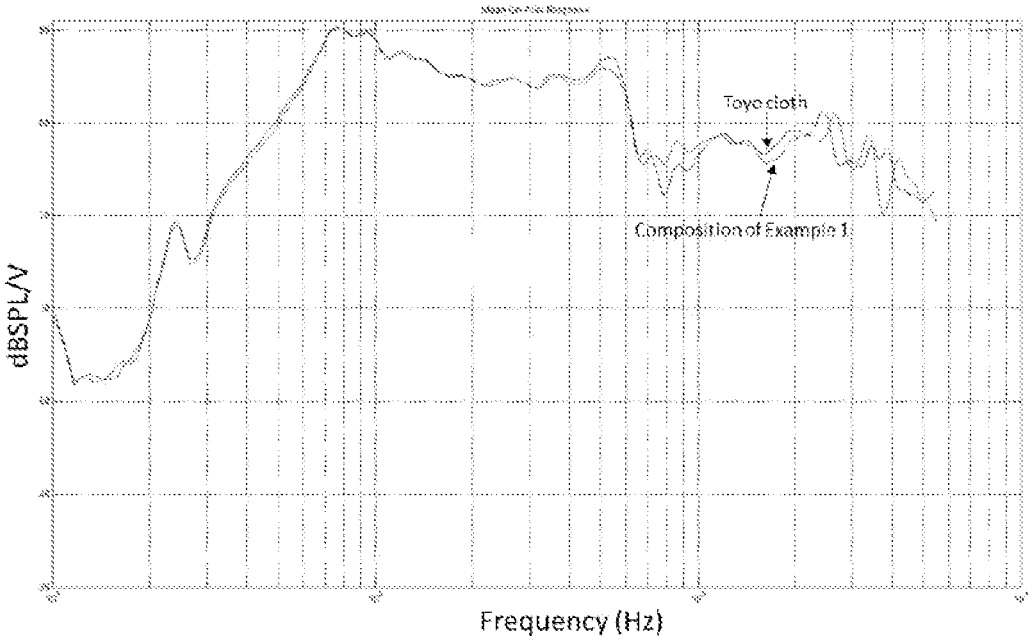
FIG. 5 shows an example acoustic curve generated by a speaker with a surround made from an example water-resistant composition as compared to an acoustic curve of a speaker with a surround made from a Toyo cloth.

In some implementations, the compositions described herein can withstand a multitude (e.g., millions) of cycles with no, or without significant, cracking or delamination. In some implementations, the compositions described herein can withstand temperatures between about −40° C. and about 120° C. with no, or without significant, melting or signs of brittleness. In some implementations, the compositions may have relatively good oxidative stability, have relatively good ultraviolet (UV) stability, and have relatively low water uptake in humid conditions. The compositions may be lightweight, e.g., weigh less than rubber which can cause increase in moving mass, and may have desirable acoustic properties, such as similar modulus and damping characteristics as those of existing cloth-based non-waterproof materials. For example, FIG. 5 shows an example acoustic curve generated by a speaker with a surround made from an example water-resistant composition as compared to an acoustic curve of a speaker with a surround made from a Toyo cloth, which is a cloth-based non-waterproof (or non-water resistant) material with 46×46 threads per inch with 6% phenolic resin and 42% SBR/NBR coating, purchased from Toyo Cloth Co., Ltd.

In general, in one aspect, the compositions provided herein include a cloth, and the cost of the raw cloth is relatively economically inexpensive and thus, keeping the overall cost of production low. In some implementations, the compositions can withstand the manufacturing processes to prepare the speaker component without resulting in tearing or pinholes, or without resulting in unacceptable tearing or pinholes. In some implementations, the compositions can be thermoformed into a desired shape and can be adhered to parts of the speaker such as a speaker cone in situ and are compatible with other components of the speaker.

In general, in one aspect, a composition provided includes a cloth which has, on each side of the cloth, a first waterproofing agent, a barrier which inhibits or prevents environmental degradation, and an elastomeric barrier including a second waterproofing agent. In another aspect, a composition described herein includes a cloth with a phenolic resin coating which has, on each side of the cloth, a first waterproofing agent, a barrier which inhibits or prevents environmental degradation, and an elastomeric barrier including a second waterproofing agent. In one aspect, example compositions include an elastomeric barrier without a second waterproofing agent, and the second waterproofing agent is applied after the elastomeric barrier. Yet in another aspect, a composition described herein includes a cloth with a phenolic resin coating which has, on each side of the cloth, a fluoropolymer, acrylic rubber, and a mixture including SBR, NBR, and a fluoropolymer. In another aspect, a composition provided herein includes a cloth which has, on one side of the cloth, a first waterproofing agent, a barrier which inhibits or prevents environmental degradation, and an elastomeric barrier including a second waterproofing agent. In some implementations, example compositions are not coated on both sides of cloth with a first waterproofing agent, a barrier which inhibits or prevents environmental degradation, and an elastomeric barrier including a second waterproofing agent; and the example compositions are coated on one side with a first waterproofing agent, a barrier which inhibits or prevents environmental degradation, and an elastomeric barrier including a second waterproofing agent.

In some implementations, the cloth is about 10-90 wt % of the composition. In some implementations, the cloth is cotton, polyester, or a mixture thereof. In some implementations, the cloth has greater than about 35 and less than about 55 warp threads per inch, and greater than about 35 and less than about 55 weft threads per inch. For example, the cloth has about 46 warp threads per inch and 46 weft threads per inch.

In some implementations, the compositions include a stiffening agent; and the stiffening agent is applied to the cloth prior to treatment with the first waterproofing agent, the barrier which inhibits or prevents environmental degradation, and the elastomeric barrier. In some implementations, the stiffening agent is phenolic resin, an epoxy, urethane, an amino resin, or a polyester. For example, stiffening agent is about 0.1-3 wt % of the composition.

In some implementations, the first waterproofing agent is a fluoropolymer, a silicone, or a hydrocarbon-based material. For example, the fluoropolymer includes about 20-30 wt % of fluoroalkyl acrylate copolymer and about 1-10 wt % tripropylene glycol.

In some implementations, the barrier which inhibits or prevents environmental degradation is about 10-90 wt % of the composition. In some implementations, the barrier which inhibits or prevents environmental degradation is an acrylic rubber. For example, the acrylic rubber includes greater than about 50 wt % of acrylic polymer.

In some implementations, the elastomeric barrier is about 10-90 wt % of the composition. In some implementations, the elastomeric barrier includes a thermoset rubber or a thermoplastic elastomer. For example, the thermoset rubber includes SBR, NBR, fluorinated rubber, polyurethane, silicone, and a mixture thereof. In some implementations, the thermoset rubber is a mixture including SBR and NBR. For example, the mixture includes about 15-20 wt % SBR and about 25-30 wt % NBR. In some implementations, the thermoplastic elastomer includes styrenic block copolymers, thermoplastic vulcanizates, thermoplastic polyurethane, thermoplastic silicone vulcanizate (TPSiV), and a mixture thereof.

In some implementations, the elastomeric barrier includes about 0.1-5 wt % of the second waterproofing agent. For example, the second waterproofing agent includes a fluoropolymer, a silicone, or a hydrocarbon-based material. In some implementations, the fluoropolymer includes about 20-30 wt % of fluoroalkyl acrylate copolymer and about 1-10 wt % tripropylene glycol.

Described herein are also example compositions that include a cloth with stiffening agent having, on each side thereof, a first waterproofing agent, a barrier which inhibits or prevents environmental degradation, and an elastomeric barrier including a second waterproofing agent, where the cloth is about 10-90 wt % of the composition.

In some implementations, compositions provided herein include a cloth with a phenolic resin coating having, on each side thereof, a first fluoropolymer, acrylic rubber, and a mixture including SBR, NBR, and a second fluoropolymer.

Described herein are also methods of producing an example composition that includes a cloth which has, on each side thereof, a first waterproofing agent, a barrier which inhibits or prevents environmental degradation, and an elastomeric barrier including a second waterproofing agent, and the method includes treating the cloth with the first waterproofing agent to produce a treated cloth; coating both sides of the treated cloth with the barrier to produce a coated cloth; and coating both sides of the coated cloth with the elastomeric barrier including the second waterproofing agent.

In one aspect, provided herein are methods of producing an example composition which includes a cloth which has, on one side of the cloth, a first waterproofing agent, a barrier which inhibits or prevents environmental degradation, and an elastomeric barrier including a second waterproofing agent and the method includes treating the one side of the cloth with the first waterproofing agent to produce a treated cloth; coating the side with the first waterproofing agent of the treated cloth with the barrier to produce a coated cloth; and coating the side with the barrier of the coated cloth with the elastomeric barrier including the second waterproofing agent.

In one aspect, the speaker component may be made from a composition which includes a cloth which has, on one side of the cloth, a first waterproofing agent, a barrier which inhibits or prevents environmental degradation, and an elastomeric barrier including a second waterproofing agent. In some implementations, the speaker component (e.g., a surround) is made from a composition which is waterproof on one side (e.g., coated on one side as described herein), and the waterproof side of the cloth may be used as the rear of the surround where waterproofing or water-resistant may be desired.

In some implementations, the methods provided herein further include treating the cloth with a stiffening agent prior to treating the cloth with the first waterproofing agent.

In general, in one aspect, the present disclosure relates to an apparatus including a component made from a composition described herein. In another aspect, the apparatus is an acoustic device such as a speaker. In some implementations, the acoustic device includes a suspension element made from a composition described herein. For example, the component is speaker component such as a surround.

Figure 6:
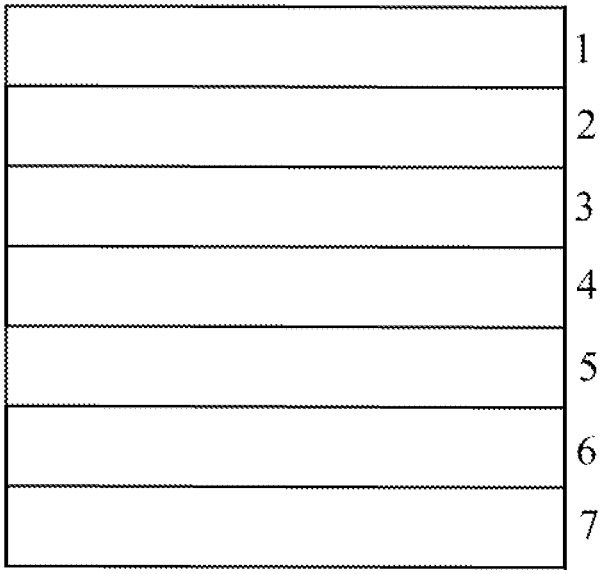
FIG. 6 shows a sectional view of an example composition.

In some implementations, the compositions described herein include seven layers as shown in FIG. 6, which is a sectional view of an example composition. For example, layer 1 can be an elastomeric barrier including a second waterproofing agent (e.g., a mixture including SBR, NBR, and a fluoropolymer); layer 2 can be a barrier which inhibits or prevents environmental degradation (e.g., acrylic rubber); layer 3 can be a first waterproofing agent (e.g., fluoropolymer); layer 4 can be a cloth (e.g., a cloth with a stiffening agent, such as phenolic resin); layer 5 can be a first waterproofing agent (e.g., fluoropolymer); layer 6 can be a barrier which inhibits or prevents environmental degradation (e.g., acrylic rubber); and layer 7 can be an elastomeric barrier including a second waterproofing agent (e.g., a mixture including SBR, NBR, and a fluoropolymer).

In some implementations, the compositions described herein can be arranged in the following order: (1) an elastomeric barrier including a second waterproofing agent (e.g., a mixture including SBR, NBR, and a fluoropolymer); (2) a barrier which inhibits or prevents environmental degradation (e.g., acrylic rubber); (3) a first waterproofing agent (e.g., fluoropolymer); (4) a cloth (e.g., a cloth with a stiffening agent, such as phenolic resin); (5) a first waterproofing agent (e.g., fluoropolymer); (6) a barrier which inhibits or prevents environmental degradation (e.g., acrylic rubber); and (7) an elastomeric barrier including a second waterproofing agent (e.g., a mixture including SBR, NBR, and a fluoropolymer). In some implementations, the compositions described herein can be arranged in the following order: (1) a mixture including SBR, NBR, and a second fluoropolymer; (2) an acrylic rubber; (3) a first fluoropolymer; (4) a cloth with a phenolic resin coating; (5) a first fluoropolymer; (6) an acrylic rubber; and (7) a mixture including SBR, NBR, and a second fluoropolymer.

Figure 1:
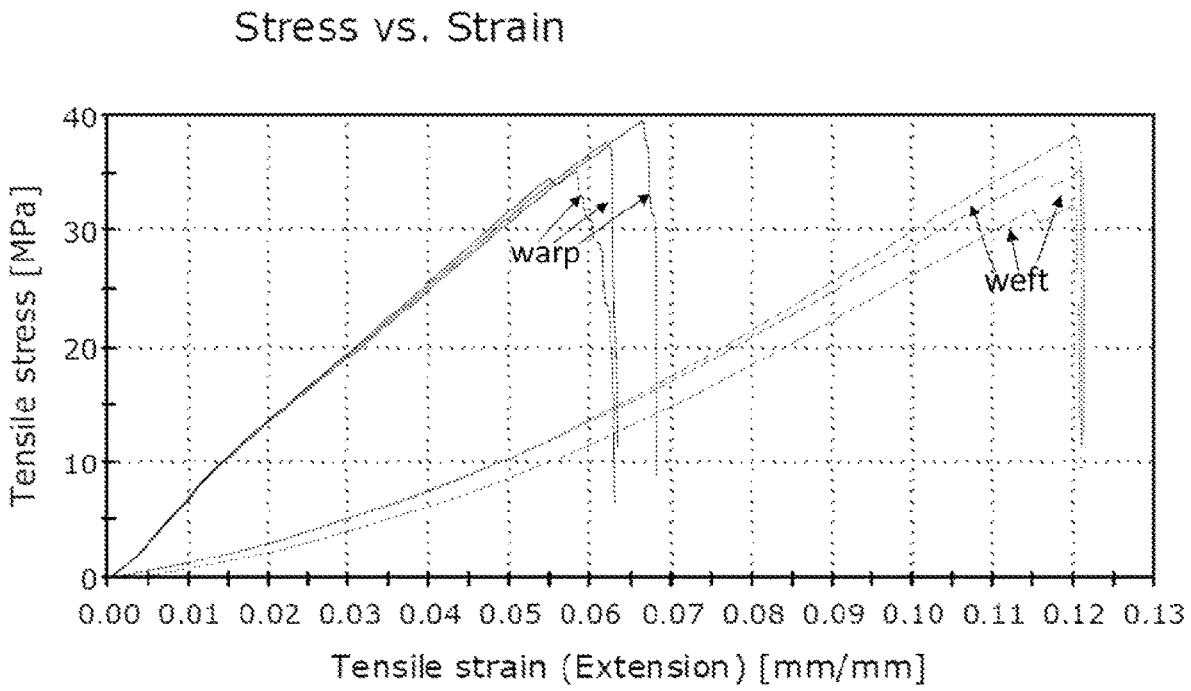
FIG. 1 shows an example graph of stress versus strain for an example water-resistant composition.

In some implementations, the compositions described herein have a stress versus strain graph substantially as depicted in FIG. 1. In FIG. 1, the data was collected using an electromechanical 5967 Instron with a 30 kN test frame and equipped with a 5 kN load cell. The samples were pulled at a rate of 50 mm/min. For example, the composition has a warp tensile strain of about 0.05-0.07 mm/mm extension and a tensile stress of about 30-40 MPa, and a weft tensile strain of about 0.11-0.13 mm/mm extension and a tensile stress of about 30-40 MPa. In some implementations, the composition described herein has an air permeability of about 0.70 cfm. Air permeability data were collected according to ASTM D737 using a FX3300 Air Permeability Tester III from Textest Instruments with a test pressure of 2000 Pa.

In some implementations, the cloth used in the composition is generally cotton, polyester, or a mixture containing cotton. For example, the cloth may be a mixture including cotton and polyester in which the percent weight or ratio of the cotton and polyester are not restricted and can vary (e.g., about 50 wt % cotton and about 50 wt % polyester, about 60 wt % cotton and about 40% polyester, about 40 wt % cotton and about 60% polyester, etc.).

In some implementations, the cloth is about 10-90 wt %, about 20-80 wt %, about 30-70 wt %, about 40-60 wt %, or about 50 wt % of the composition described herein. In some implementations, the cloth is about 10-90 wt % of the composition. In some implementations, the cloth is about 50 wt % of the composition. In some implementations, the cloth is about 50-55 wt %, about 52-54 wt %, or about 53 wt % of the composition. In some implementations, the cloth is greater than about 50 wt %, greater than about 75 wt %, greater than about 80 wt %, or greater than about 90 wt % of the composition. In some implementations, the cloth is less than about 50 wt %, less than about 30 wt %, less than about 25 wt %, or less than about 20 wt % of the composition. In some implementations, the fraction of the cloth is about 0.1-0.9, about 0.2-0.8, about 0.3-0.7, about 0.4-0.6, or about 0.5 of the composition. In an example, the fraction of the cloth is about 0.1-0.9 of the composition. In some implementations, the fraction of the cloth is about 0.5 of the composition. In some implementations, the composition includes a cloth with a stiffening agent which has, on each side of the cloth, a first waterproofing agent, a barrier to inhibit or prevent environmental degradation, and an elastomeric barrier including a second waterproofing agent, wherein the cloth is about 10-90 wt % of the composition.

In some implementations, the cloth has greater than about 35 and less than about 55 warp threads per inch, and greater than about 35 and less than about 55 weft threads per inch. In some implementations, the cloth has greater than about 35 and less than about 55, greater than about 40 and less than about 50, or greater than about 45 and less than about 47 warp threads per inch. In an example, the cloth has 46 warp threads per inch. In an example, the cloth has greater than about 35 and less than about 55, greater than about 40 and less than about 50, or greater than about 45 and less than about 47 weft threads per inch. In some implementations, the cloth has 46 weft threads per inch. In an example, the cloth has 46 warp threads per inch and 46 weft threads per inch.

Figure 2:
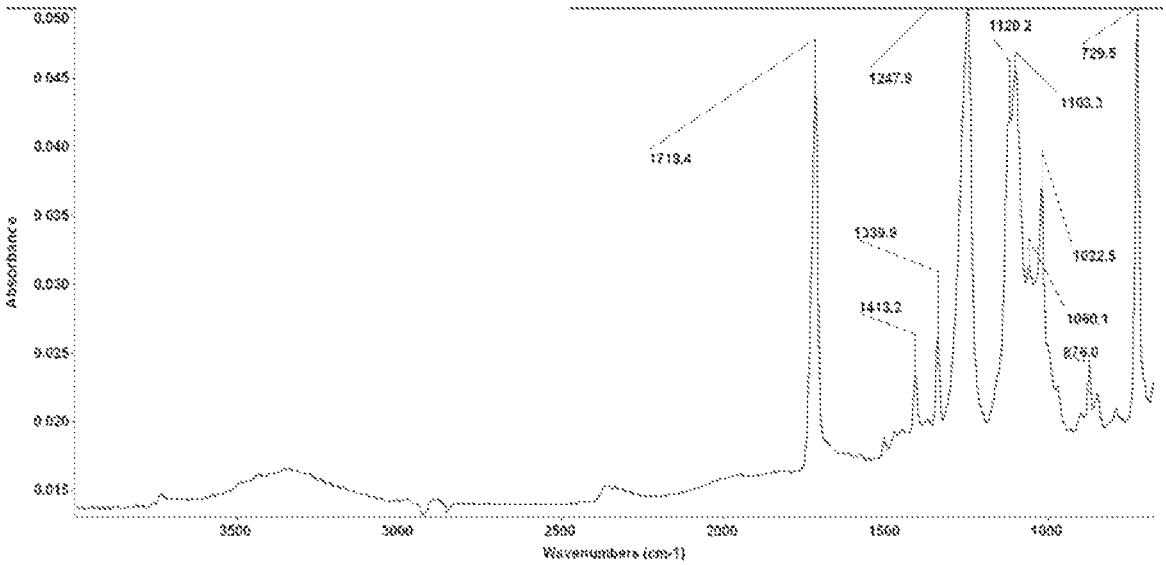
FIG. 2 shows an example Fourier transform infrared (FT-IR) spectrum of a cotton-polyester cloth with 46 warp threads per inch and 46 weft threads per inch.

The cloth can be characterized by Fourier transform infrared spectroscopy (FT-IR). In some implementations, the cloth has at least two characteristic FT-IR peaks, in terms of wave numbers, at about 1719 $cm^{-1}$, about 1248 $cm^{-1}$, and about 1103 $cm^{-1}$. In some implementations, the cloth has at least three or at least four characteristic FT-IR peaks, in terms of wave numbers, at about 1719 $cm^{-1}$, about 1248 $cm^{-1}$, about 1103 $cm^{-1}$, about 1023 $cm^{-1}$, and about 730 $cm^{-1}$. In an example, the cloth has an FT-IR spectrum substantially as depicted in FIG. 2. The FT-IR spectrum was collected using a Nicolet 6700 spectrometer from ThermoFisher, equipped with a germanium crystal. FIG. 2 shows a FT-IR spectrum of a cotton-polyester cloth with 46 warp threads per inch and 46 weft threads per inch.

In some implementations, the composition described herein can include a stiffening agent. The stiffening agent may be applied to the cloth prior to treatment with the first waterproofing agent, the barrier which inhibits or prevents environmental degradation, and the elastomeric barrier. The stiffening agent may be used to enhance the stiffness and/or rigidity of the cloth. In some implementations, compositions without the stiffening agent could also be used, and can be sufficiently stiff and/or rigid for the uses described herein. Examples of the stiffening agent include, but are not limited to, phenolic resin, epoxies, urethanes, amino resins (e.g., urea-formaldehyde), and polyesters (e.g., alkyds). In an example, the stiffening agent is phenolic resin. Phenolic resin can be used to impregnate the cloth described herein to make the cloth more rigid and to provide stiffness to maintain the shape. Phenolic resin coats the fibers of the cloth and forms bridges between the warp and weft threads, which provide stiffness while still allowing air to permeate through the cloth.

Figure 3:
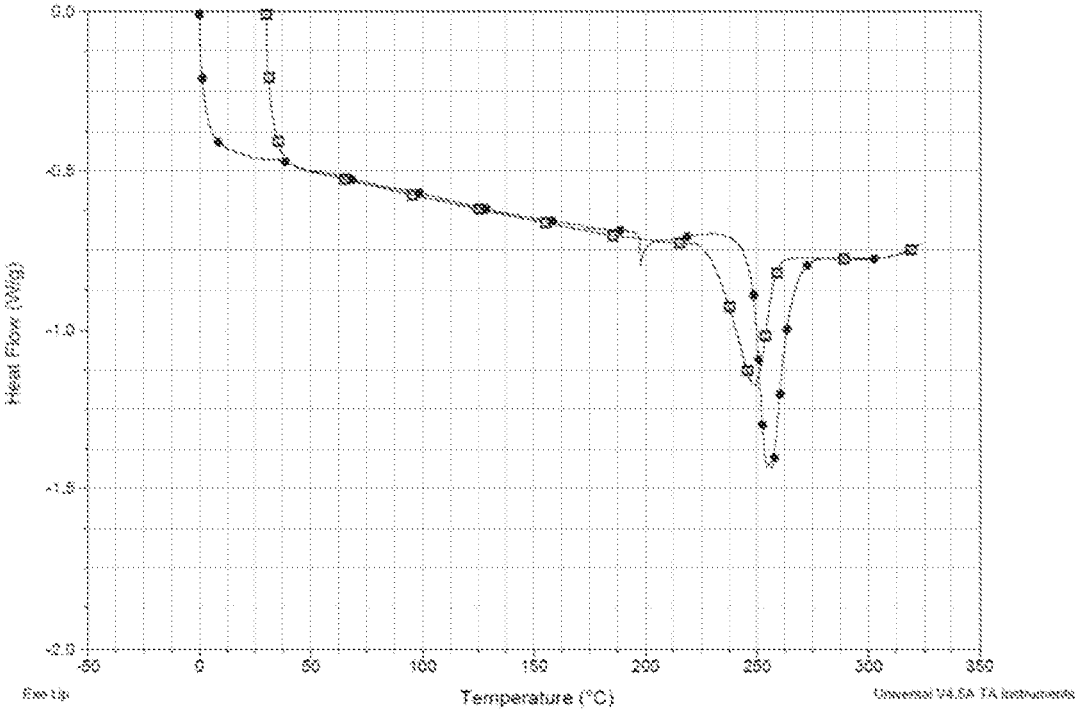
FIG. 3 shows an example differential scanning calorimetry (DSC) thermogram of a cloth with phenolic resin.

In some implementations, the stiffening agent (e.g., phenolic resin) is about 0.1-3 wt %, about 0.5-3 wt %, about 1-3 wt % or about 2 wt % of the composition. In an example, the stiffening agent (e.g., phenolic resin) is about 0.1-3 wt % of the composition. In some implementations, the stiffening agent (e.g., phenolic resin) is about 1-3 wt % of the composition. In an example, the stiffening agent (e.g., phenolic resin) is about 2 wt % of the composition. In some implementations, the cloth with phenolic resin has an endothermic event at about 255° C. as determined by DSC. The cloth with phenolic resin can further have an endothermic event at about 198° C. as determined by DSC. For example, the cloth with phenolic resin has a DSC thermogram substantially as depicted in FIG. 3. The DSC data were collected using a Q2000 Differential Scanning calorimeter from TA Instruments with a heat rate of 20° C./min. In this regard, FIG. 3 shows a DSC thermogram of a cloth (46 warp threads per inch and 46 weft threads per inch) with phenolic resin. The first heat cycle is shown in solid circles. The second heat cycle is showed in open squares.

The waterproofing agent described herein is an agent that inhibits or prevents the absorption of water by the composition and that may be usable to coat the cloth described herein. In some implementations, the first and second waterproofing agents are different. In some implementations, the first and the second waterproofing agents are the same. Examples of the waterproofing agent include, but not limited to, fluorochemical (e.g., a fluoropolymer), a silicone, or a hydrocarbon-based material (e.g., a wax). In some implementations, the first waterproofing agent is a fluoropolymer. In an example, the second waterproofing agent is a fluoropolymer. In an example, the first and second waterproofing agent are a fluoropolymer. In some implementations, the fluoropolymer includes about 20-30 wt % of fluoroalkyl acrylate copolymer and about 1-10 wt % tripropylene glycol. In an example, the fluoropolymer further includes water.

A barrier, as described herein may be used to provide resistance to water and soapy water, and to inhibit or prevent environmental degradation, which can cause changes in the properties of a composition such as changes in strength, color, shape, etc. under the influence air (e.g., oxygen), light and heat. Changes due to oxidative and UV degradation can include cracking and chemical disintegration of the composition and thus, change the acoustic property and durability of the composition. In some implementations, the barrier which inhibits or prevents environmental degradation is about 10-90 wt %, about 10-80 wt %, about 10-70 wt %, about 10-60 wt %, about 10-50 wt %, about 10-40 wt %, about 10-30 wt %, about 10-20 wt %, about 20-30 wt %, about 24-28 wt %, about 25-27 wt %, about 26-27 wt %, or about 27 wt % of the composition. In an example, the barrier which inhibits or prevents environmental degradation is about 10-90 wt % of the composition. In an example, the barrier which inhibits or prevents environmental degradation is about 20-30 wt % of the composition. In some implementations, the barrier is about 24-28 wt %, about 25-27 wt %, about 26-27 wt %, or about 27 wt % of the composition. In an example, the barrier is about 27 wt % of the composition. In some implementations, the fraction of the barrier which inhibits or prevents environmental degradation is about 0.1-0.9, about 0.1-0.8, about 0.1-0.7, about 0.1-0.6, about 0.1-0.5, about 0.1-0.4, about 0.2-0.3, or about 0.3 of the composition. In an example, the fraction of the barrier which inhibits or prevents environmental degradation is about 0.1-0.9 of the composition.

Examples of a barrier that inhibit or prevent environmental degradation include, but not limited to, thermoset rubbers and thermoplastic elastomers. Examples of thermoset rubbers and thermoplastic elastomers may include one or more antioxidants. Antioxidants can inhibit the formation of free radicals and thus, they may enhance the stability of polymers against environmental degradation such as oxidative, light, and heat degradations. Examples of thermoset rubber includes, but not limited to, SBR, NBR, polyurethane, fluorinated rubber (e.g., Viton), silicone, and a mixture thereof. Examples of thermoplastic elastomer include, but not limited to, styrenic block copolymers, thermoplastic vulcanizates, thermoplastic polyurethane, thermoplastic silicone vulcanizate (TPSiV), and a mixture thereof. In an example, the barrier is a mixture including SBR, NBR, and one or more antioxidants. In an example, the barrier is an acrylic rubber. In some implementations, the acrylic rubber includes greater than about 50 wt %, greater than about 75 wt %, greater than about 80 wt %, greater than about 85 wt %, greater than about 90 wt %, or greater than about 95 wt % of acrylic polymer. In some implementations, the acrylic rubber includes greater than about 50 wt % of acrylic polymer. In some implementations, the acrylic rubber includes greater than about 85% of acrylic polymer.

In some implementations, the elastomeric barrier is about 10-90 wt %, about 10-80 wt %, about 10-70 wt %, about 10-60 wt %, about 10-50 wt %, about 10-40 wt %, about 10-30 wt %, about 10-20 wt %, or about 20 wt % of the composition. For example, the elastomeric barrier is about 10-90 wt % of the composition. In some implementations, the elastomeric barrier is about 10-30 wt % of the composition. In some implementations, the elastomeric barrier is about 10-20 wt % of the composition. In some implementations, the elastomeric barrier is about 15-20 wt %, about 16-18 wt %, or about 17 wt % of the composition. In an example, the elastomeric barrier is about 15 wt %, about 16 wt %, about 17 wt %, about 18 wt %, about 19 wt %, or about 20 wt % of the composition. In an example, the elastomeric barrier is about 17 wt % of the composition. In some implementations, the fraction of the elastomeric barrier is about 0.1-0.9, about 0.1-0.8, about 0.1-0.7, about 0.1-0.6, about 0.1-0.5, about 0.1-0.4, about 0.1-0.3, or about 0.2 of the composition. In some implementations, the fraction of the elastomeric barrier is about 0.1-0.9 of the composition. In one aspect, example compositions include an elastomeric barrier without a second waterproofing agent, and the second waterproofing agent is applied after the elastomeric barrier coating.

Examples of the elastomeric barrier include, but not limited to, a thermoset rubber and a thermoplastic elastomer. For example, the elastomeric barrier is a thermoset rubber. Examples of the thermoset rubber include, but not limited to, SBR, NBR, polyurethane, fluorinated rubber (e.g., Viton), silicone, and a mixture thereof. In some implementations, the elastomeric barrier is a thermoplastic elastomer. Examples of thermoplastic elastomer include, but not limited to, styrenic block copolymers, thermoplastic vulcanizates, thermoplastic polyurethane, thermoplastic silicone vulcanizate (TPSiV), and a mixture thereof.

Figure 4:
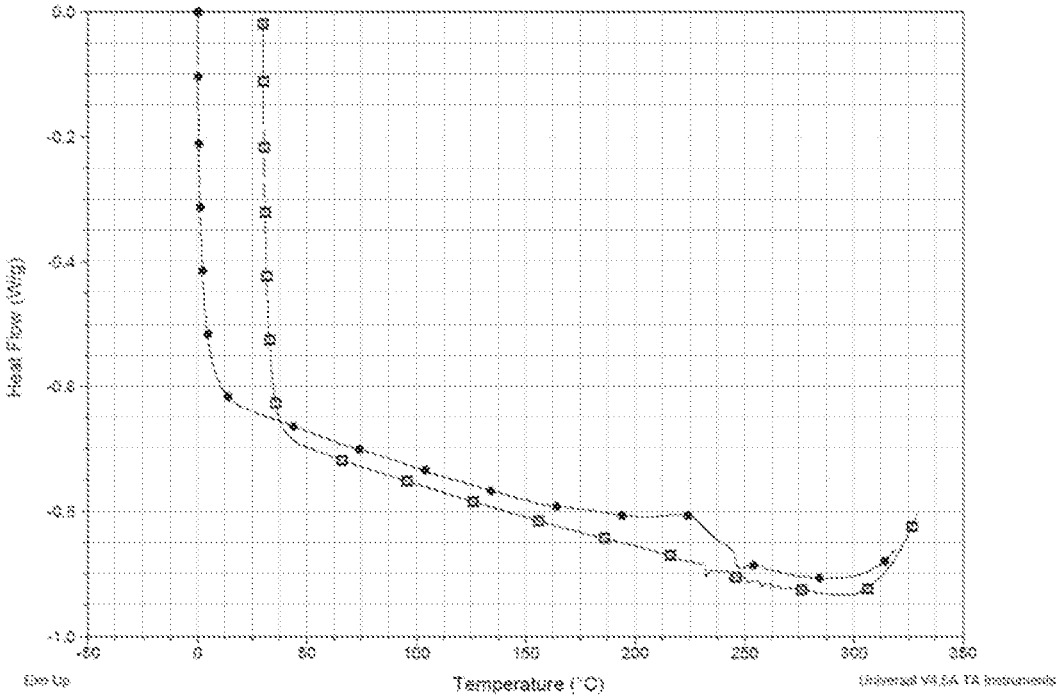
FIG. 4 shows an example DSC thermogram of a mixture including SBR and NBR.

In some implementations, the thermoset rubber is, or includes, a mixture including SBR and NBR. For example, the mixture including SBR and NBR has an endothermic event at about 248° C. as determined by DSC. In another example, the mixture including SBR and NBR further has exothermic event at about 224° C. as determined by DSC. For example, the mixture including SBR and NBR has a DSC thermogram substantially as depicted in FIG. 4. The DSC data were collected using a Q2000 Differential Scanning calorimeter from TA Instruments with a heat rate of 20° C./min. FIG. 4 shows an example DSC thermogram of a mixture including SBR and NBR, where the first heat cycle is shown in solid circles, and the second heat cycle is showed in open squares. In some implementations, the mixture includes about 15-20 wt % SBR and about 25-30 wt % NBR. In an example, the mixture includes about 18 wt % SBR and about 28 wt % NBR. In one aspect, the elastomeric barrier includes about 0.1-5 wt %, about 0.5-4 wt %, about 0.5-3 wt %, about 0.5-2 wt %, about 0.5-2 wt %, or about 1 wt % of a second waterproofing agent described herein. In an example, the elastomeric barrier includes about 0.1-5 wt % of the second waterproofing agent. In some implementations, the elastomeric barrier includes about 0.5-2 wt % of the second waterproofing agent. In an example, the elastomeric barrier includes about 1 wt % of a second waterproofing agent (e.g., fluorochemical (such as a fluoropolymer), a silicone, or a hydrocarbon-based material). In some implementations, the second waterproofing agent is a fluoropolymer including about 20-30 wt % of fluoroalkyl acrylate copolymer and about 1-10 wt % tripropylene glycol. In some implementations, the elastomeric barrier may not include second waterproofing agent, and the second waterproofing may be applied after the elastomeric barrier.

The present disclosure also relates to methods of preparing the compositions described herein including

- operation 1: treating the cloth with a first waterproofing agent,
- operation 2: coating both sides of the cloth from operation 1 with a barrier which inhibits or prevents environmental degradation, and
- operation 3: coating both sides of the cloth from operation 2 with an elastomeric barrier including a second waterproofing agent.

In some implementations, example process described herein further includes treating the cloth with a stiffening agent as described herein prior to treatment with a first waterproofing agent. Stated otherwise, in some implementations, the cloth is treated with a stiffening agent prior to subjecting the cloth to operation 1 above. For example, the cloth is dipped in a stiffening agent such as phenolic resin. In operation 1, the cloth (e.g., a cloth coated with phenolic resin) is treated with a first waterproofing agent as described herein, such as a fluoropolymer (e.g., about 1-3 wt % or about 2 wt % of fluoropolymer). In operation 2, both sides of the cloth from operation 1 are coated with a barrier which inhibits or prevents environmental degradation (e.g., an acrylic rubber). In operation 3, both sides of the cloth from operation 2 are coated with an elastomeric barrier including a second waterproofing agent (e.g., a mixture including SBR, NBR, and about 0.5-2 wt % or about 1 wt % of fluoropolymer).

In some implementations, an example method of preparing the composition provided herein includes:

- treating the cloth with a first waterproofing agent to provide a treated cloth,
- coating both sides of the treated cloth with a barrier which prevents against environmental degradation to provide a coated cloth, and
- coating both sides of the coated cloth with an elastomeric barrier which includes a second waterproofing agent to provide the composition. In some implementations, the method provided herein further includes treating the cloth with a stiffening agent prior to treatment with a first waterproofing agent.

In some implementations, one side of the cloth is treated with a first waterproofing agent, a barrier which inhibits or prevents environmental degradation, and an elastomeric barrier including a second waterproofing agent. In some implementations, one or both sides of the cloth are treated and/or coated with one or more of the items described herein (e.g., stiffening agent, first waterproofing agent, barrier which inhibits or prevents environment degradation, and an elastomeric barrier including a second waterproofing agent).

In one aspect, example compositions include an elastomeric barrier without a second waterproofing agent, and the second waterproofing agent is applied after the coating of elastomeric barrier.

In some implementations, temperature values in connection with DSC or other thermal experiments provided herein can vary about ±3° C. depending on the instrument, specific conditions, sample preparation, etc. In some implementations, wave number values in connection with FT-IR experiments can vary ±3 $cm^{-1}$, and values in stress and strain can vary ±10%. A sample described herein having a DSC thermogram, FT-IR spectrum, or a graph of stress vs. strain "substantially" as shown in any of the Fig.s would accommodate such variations. Further, the temperature values, wave number values, or stress and strain values together with the term "about" also accommodate such variations.

In some implementations, the term "about" refers to plus or minus 10% of the value.

The disclosure will be described in greater detail by way of specific examples. The following examples are offered for illustrative purposes, and are not intended to limit the scope of the claims.

EXAMPLES

Example 1

Preparation and Characterization of a Composition

The starting materials used to prepare a composition are commercially available from various sources. The raw cloth, which is a mixture of cotton and polyester, fluoropolymer, phenolic resin, acrylic rubber, and the mixture of SBR and NRB were purchased from Hai Rui Electroacoustic Material Co., Ltd. The fluoropolymer can also be purchased from Daikin America, Inc., which is available under the trade name Unidyne TG5503. The acrylic rubber can also be purchased from Jin Rui Electronics, Ltd under the product name Coating Glue (PH-W01B-UV). The raw cloth used has 46 warp threads per inch and 46 weft threads per inch.

The raw cloth (16"×16", 145 g±10 wt %) is dipped in phenolic resin, where the weight of the cloth is increased by 6 g±2 wt %. The cloth with phenolic resin is dried and then it is treated on both sides with 2% fluoropolymer. The resulting composition is then treated on one side with acrylic rubber, where the weight of the composition is increased by 37 g±3 wt %. The composition is then treated on the other side with acrylic rubber, where the weight of the composition is increased by 36 g±3 wt %. The resulting composition is further treated on one side with a mixture of SBR, NBR, and 1% fluoropolymer, where the weight of the composition is increased by 24 g±2 wt %. Similarly, the composition is treated on the other side with a mixture of SBR, NBR, and 1% fluoropolymer, where the weight of the composition is increased by 24 g±2 wt %. The final weight of the composition is 273 g.

The composition prepared according to the procedures above was studied to determine its stress vs. strain and air permeability characteristics and waterproof property.

Specifically, for the stress vs. strain test, samples of the composition were cut into Type IV dogbones and tested in tension using an electromechanical 5967 Instron with a 30 kN test frame. The Instron was equipped with a 5 kN load cell. Samples were pulled at a rate of 50 mm/min. FIG. 1 shows a graph of stress vs. strain of a composition prepared according to the procedures above.

Air permeability was measured according to ASTM D737 using a FX3300 Air Permeability Tester III from Textest Instruments with a test pressure of 2000 Pa. Air permeability of the cloth was measured to be 0.703 cfm (n=10, stdev=0.16 cfm).

A Mullens tester was used to study the waterproof property of the composition. A sample was flexed five times within one minute by applying and releasing a pressure of 30 psi, and after the fifth flex, the pressure of 30 psi was maintained for 60 seconds. The surface of the sample was visually inspected for water. A high flow water test was also employed to evaluate speaker components made from a composition prepared according to the procedures above. The speaker component was continuously sprayed with water at a rate of 3.1 liter of water per minute for 24 hours as the speaker component was flexed for one hour on followed by one hour off increments. The speaker component was tested at 80% of its resonance frequency at half the maximum power. The surface of the speaker component was visually inspected for water. The composition passed both of these tests, indicating that the composition was waterproof.

The acoustic property of a speaker made from a composition prepared according to the procedures above was also examined. The composition was thermoformed into a surround and built into a 6×9 woofer. A speaker with a surround made from a composition prepared according to the procedures above has a similar acoustic curve as a speaker with a surround made from a Toyo cloth, which is a non-waterproof (or non-water resistant) cloth with 46×46 threads per inch with 6% phenolic resin and 42% SBR/NBR coating purchased from Toyo Cloth Co., Ltd. See FIG. 5.

Elements of different implementations described herein may be combined to form other embodiments not specifically set forth above. In some cases, elements may be left out of the compositions described herein without adversely affecting their operation. Furthermore, various separate elements may be combined into one or more individual elements to perform the functions described herein.

What is claimed:

1. An apparatus comprising a speaker component, wherein the speaker component is a surround and the surround is made from a composition comprising:

a cloth treated with a stiffening agent comprising about 0.1-3 wt % of the composition; and a series of layers on each side of the cloth applied in the following order:

a first layer comprising a first waterproofing agent;

a second layer comprising a barrier which inhibits or prevents environmental degradation, wherein the barrier is an acrylic rubber and the acrylic rubber comprises greater than about 50 wt % of acrylic polymer; and a third layer comprising an elastomeric barrier comprising a second waterproofing agent.

2. The apparatus of claim 1, wherein the cloth is about 10-90 wt % of the composition.

3. The apparatus of claim 1, wherein the cloth is cotton, polyester, or a mixture thereof.

4. The apparatus of claim 1, wherein the cloth has greater than about 35 and less than about 55 warp threads per inch, and greater than about 35 and less than about 55 weft threads per inch.

5. The apparatus of claim 4, wherein the cloth has about 46 warp threads per inch and 46 weft threads per inch.

6. The apparatus of claim 1, wherein the stiffening agent is phenolic resin, an epoxy, urethane, an amino resin, or a polyester.

7. The apparatus of claim 1, wherein the first waterproofing agent is a fluoropolymer, a silicone, or a hydrocarbon-based material.

8. The apparatus of claim 7, wherein the fluoropolymer comprises about 20-30 wt % of fluoroalkyl acrylate copolymer and about 1-10 wt % tripropylene glycol.

9. The apparatus of claim 1, wherein the barrier which inhibits or prevents environmental degradation is about 10-90 wt % of the composition.

10. The apparatus of claim 1, wherein the elastomeric barrier is about 10-90 wt % of the composition.

11. The apparatus of claim 1, wherein the elastomeric barrier is a thermoset rubber or a thermoplastic elastomer.

12. The apparatus of claim 11, wherein the thermoset rubber is SBR, NBR, fluorinated rubber, polyurethane, silicone, or a mixture thereof.

13. The apparatus of claim 12, wherein the thermoset rubber is a mixture comprising SBR and NBR.

14. The apparatus of claim 13, wherein the mixture comprises about 15-20 wt % SBR and about 25-30 wt % NBR.

15. The apparatus of claim 11, wherein the thermoplastic elastomer is styrenic block copolymers, thermoplastic vulcanizates, thermoplastic polyurethane, thermoplastic silicone vulcanizate (TPSiV), or a mixture thereof.

16. The apparatus of claim 1, wherein the elastomeric barrier comprises about 0.1-5 wt % of the second waterproofing agent.

17. The apparatus of claim 16, wherein the second waterproofing agent is a fluoropolymer, a silicone, or a hydrocarbon-based material.

18. The apparatus of claim 16, wherein the fluoropolymer comprises about 20-30 wt % of fluoroalkyl acrylate copolymer and about 1-10 wt % tripropylene glycol.

19. An apparatus comprising a speaker component, wherein the speaker component is a surround and the surround is made from a composition comprising:

- a cloth treated with a phenolic resin coating; and
- a series of layers on each side of the cloth applied in the following order:
  - a first layer comprising a first fluoropolymer,
  - a second layer comprising acrylic rubber, wherein the acrylic rubber comprises greater than about 50 wt % of acrylic polymer, and
  - a third layer comprising a mixture comprising SBR, NBR, and a second fluoropolymer.

20. A method of producing the composition comprising the cloth of claim 1, wherein the method comprising:

- treating the cloth with a stiffening agent to produce a first treated cloth;
- treating the first treated cloth with the first waterproofing agent to produce a second treated cloth;
- coating both sides of the second treated cloth with the barrier to produce a coated cloth; and
- coating both sides of the coated cloth with the elastomeric barrier comprising the second waterproofing agent.

* * * * *